United States Patent [19]

Miller

[11] Patent Number: 4,823,507

[45] Date of Patent: Apr. 25, 1989

[54] WINDOW REGULATOR MECHANISM FOR FRAMELESS WINDOWS

[75] Inventor: Larry D. Miller, Rochester, Mich.

[73] Assignee: General Motors Corporation, Detroit, Mich.

[21] Appl. No.: 65,946

[22] Filed: Jun. 24, 1987

[51] Int. Cl.[4] ..... E05F 11/52

[52] U.S. Cl. ..... 49/227; 49/348; 49/360; 49/374

[58] Field of Search ..... 49/360, 351, 374, 375, 49/227, 348, 349, 350, 352, 363

[56] References Cited

U.S. PATENT DOCUMENTS

| | | | |
|---|---|---|---|
| 2,878,056 | 8/1956 | Brueder | 296/44 |
| 3,413,760 | 12/1968 | Gorys et al. | 49/375 |
| 3,591,982 | 7/1971 | Nantau | 49/375 X |
| 4,051,632 | 10/1977 | Fukumoto et al. | 49/375 X |
| 4,089,134 | 5/1978 | Koike | 49/374 X |
| 4,183,178 | 1/1980 | Kiefer et al. | 49/375 |
| 4,241,542 | 12/1980 | Podolan et al. | 49/375 X |
| 4,420,906 | 12/1983 | Pickles | 49/375 X |
| 4,483,100 | 11/1984 | Blankenburg et al. | 49/352 |

FOREIGN PATENT DOCUMENTS

| | | |
|---|---|---|
| 2808235 | 8/1979 | Fed. Rep. of Germany . |
| 3210468 | 9/1983 | Fed. Rep. of Germany . |

*Primary Examiner*—Philip C. Kannan
*Attorney, Agent, or Firm*—William A. Schuetz

[57] ABSTRACT

A door assembly with a frameless window has a window regulator mechanism for raising and lowering the window and which includes a guide arrangement for stabilizing the window in all directions when being raised and lowered and which causes the upper end of the window to be moved away from its associated seal and the lower end thereof to be moved toward the inner door panel about a belt line pivot point upon being lowered while simultaneously causing the window to be moved longitudinally of the door, and vice versa, upon the window being lowered and raised, respectively.

6 Claims, 3 Drawing Sheets

WINDOW REGULATOR MECHANISM FOR FRAMELESS WINDOWS

The present invention relates to a frameless door assembly for an automotive vehicle and, more particularly, to a window regulator mechanism for supporting, guiding and moving an unframed window of a vehicle door of a hard top type vehicle in a manner such that it provides high window stability in all directions and effectuates movement of the window toward and from its associated exterior seal on the vehicle as the window approaches and leaves its closed position.

Heretofore window regulators or glass drop mechanisms have been provided for guiding and moving a window of an automotive vehicle between open and closed positions and in which the window is moved away from its seal during initial opening movement and into engagement with the seal during the latter stages of its closing movement. In these arrangements the window and a surrounding frame were guided via guide channels and guides for effectuating this type of movement. Examples of such arrangements are shown in U.S. Pat. No. 4,483,100 and German Pat. Nos. 32 10 468 and 28 08 235. It is also known to provide such a window regulator mechanism for use in a door assembly in which the window is unframed, i.e., has no frame surrounding its top and upper side portions of its sides when in the closed position. U.S. Pat. No. 2,878,056 is an example of such an arrangement.

It is a broad object of the present invention to provide a new and improved vehicle door assembly having a frameless window for use with an automotive vehicle, such as a hardtop, having body structure defining an opening surrounded by an exterior seal, and wherein the door assembly has a window regulator or glass drop mechanism for supporting, guiding and moving the window between open and closed positions which is of a relatively simple construction and which is so constructed and arranged that it provides stability for the window in all directions regardless of the position of the window and which causes the window to be moved away from and toward its associated seal as it leaves and approaches its closed position.

Another object of the present invention is to provide a new and improved vehicle door assembly, as defined in the next preceding object, and wherein the window is caused to pivot about the belt line of the vehicle door assembly as it is being lowered to move the upper portion thereof away from the seal and its lower portion away from the outer panel of the door during a first portion of its downward movement and then to move in a path which follows the radius of curvature of the window during a second portion of its downward movement.

Yet another object of the present invention is to provide a new and improved vehicle door assembly, as defined in the preceding objects, and in which the window is also guided and moved translationally or longitudinally of the door as it is being lowered and raised.

A further object of the present invention is to provide a new and improved vehicle door assembly, as defined in any of the preceding objects, and wherein the window regulator mechanism comprises a pair of spaced apart curved guide posts or tubes and the window carries pairs of horizontally slotted, vertically spaced guides slidably disposed on the guide posts and wherein the configuration of the guide posts and slots in the guides is such that the window is caused to pivot about the belt line of the door so that its upper end portion is moved away from the seal and its lower end portion is moved away from the outer door panel as it moves downwardly through a first portion of its downward movement and then moves downwardly along a path which follows the radius of curvature of the window during a latter portion of its downward movement and at the same time the window is caused to be moved longitudinally relative to the door, and wherein the window is moved through a reverse path during its upward movement.

The present invention further resides in various novel constructions and arrangement of parts, and further objects, novel characteristics and advantages of the present invention will be apparent to those skilled in the art to which it relates and from the following detailed description of the illustrated, preferred embodiment hereof made with reference to the accompanying drawings forming a part of this specification and in which similar reference numerals are employed to designate corresponding parts throughout the several views and in which.

Figure 1:
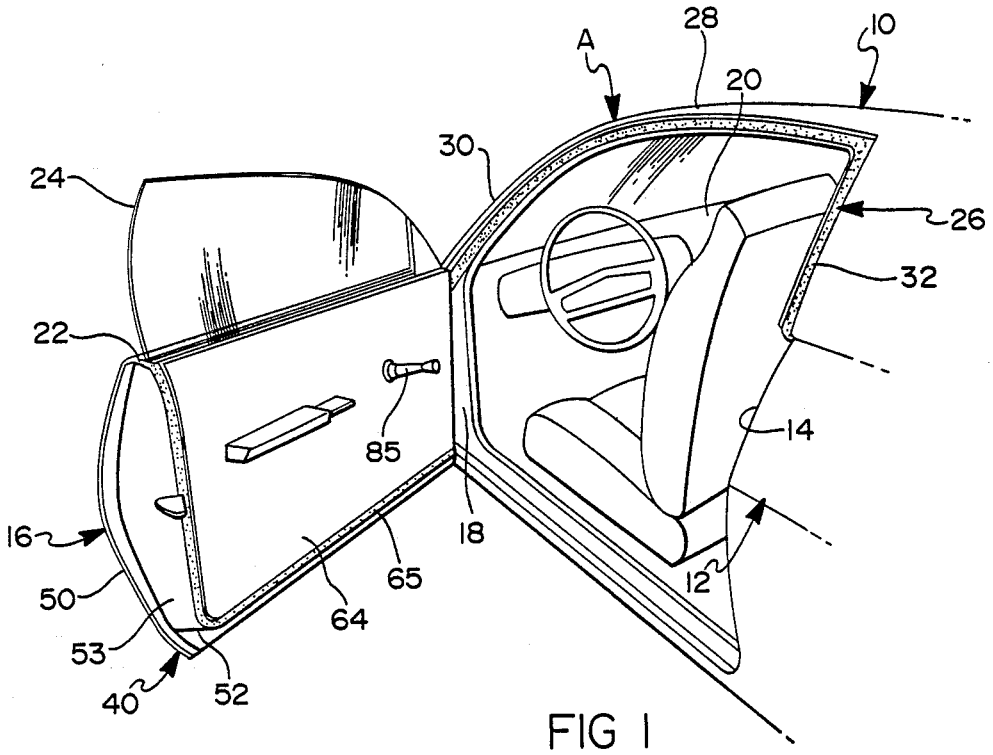
FIG. 1 is a fragmentary perspective view of an automotive vehicle incorporating the novel door assembly of the present invention.

Referring to FIG. 1 of the drawings, an automotive hard top type vehicle A is thereshown. The vehicle A includes a roof 10, side body structure 12 defining a side body opening 14 and a door assembly 16 which is hinged via hinges (not shown) to an A pillar 18 of the side body structure 14 and which is movable between an open position, as shown in FIG. 1, and a closed position in which it closes off the side opening 14 of the vehicle so as to permit ingress and egress to the interior passenger compartment 20 of the vehicle, respectively. The door assembly 16 has an upper end defining a belt line 22 and carries a vertically movable curved side window 24 which is unframed and which when in the closed position engages an exterior seal 26 extending along the top 28 and upper side portions 30 and 32 of the opening 14 of the body structure 12 of the vehicle A.

Figure 2:
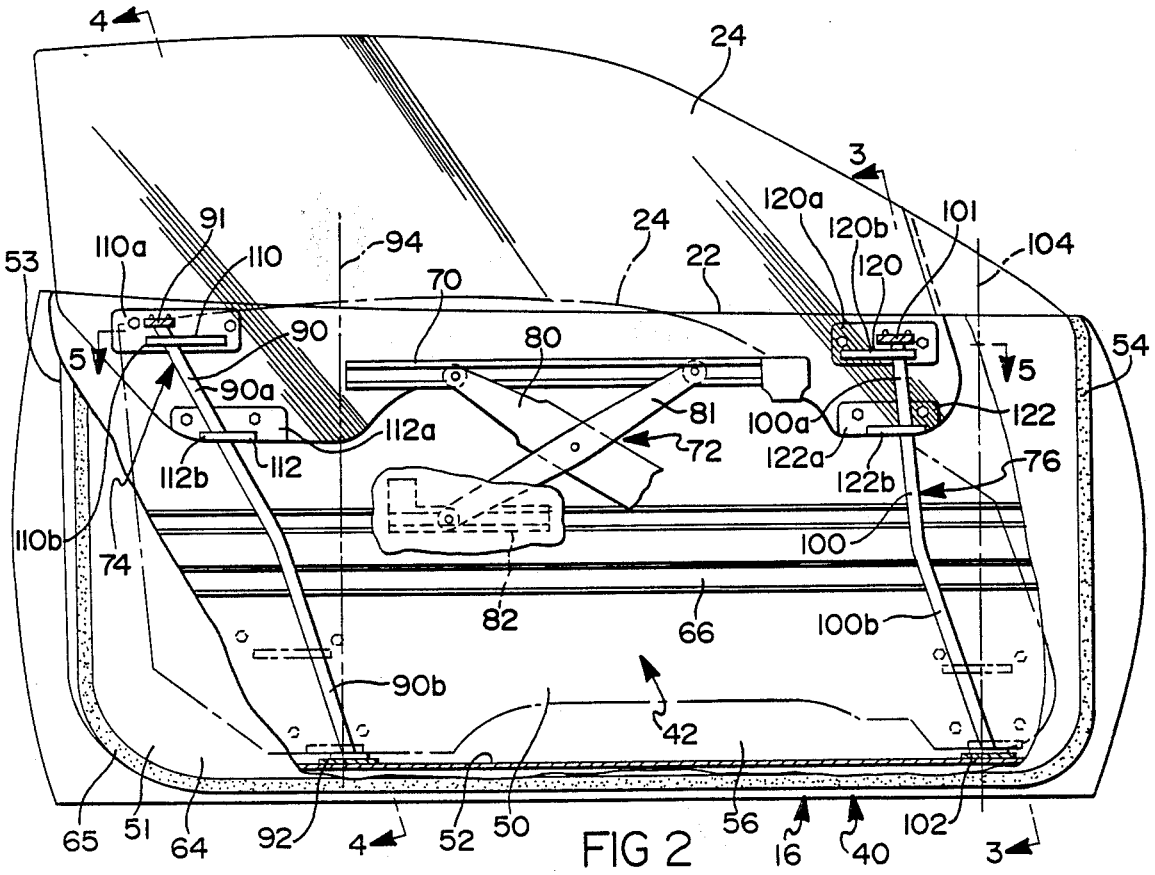
FIG. 2 is an enlarged plan view, with portions broken away, of the novel vehicle door assembly of the present invention and with the door assembly being viewed from its interior side thereof.

The door assembly 16 comprises, in general, a vehicle door subassembly 40, the side window 24 and a window regulator or glass drop mechanism 42 for supporting, guiding and moving the unframed window 24 between a lower or open position, as shown by the phantom lines in FIG. 2, in which it is virtually wholly disposed within the door subassembly 40 and a closed or upper position, as shown by the solid lines in FIG. 2.

Figure 3:
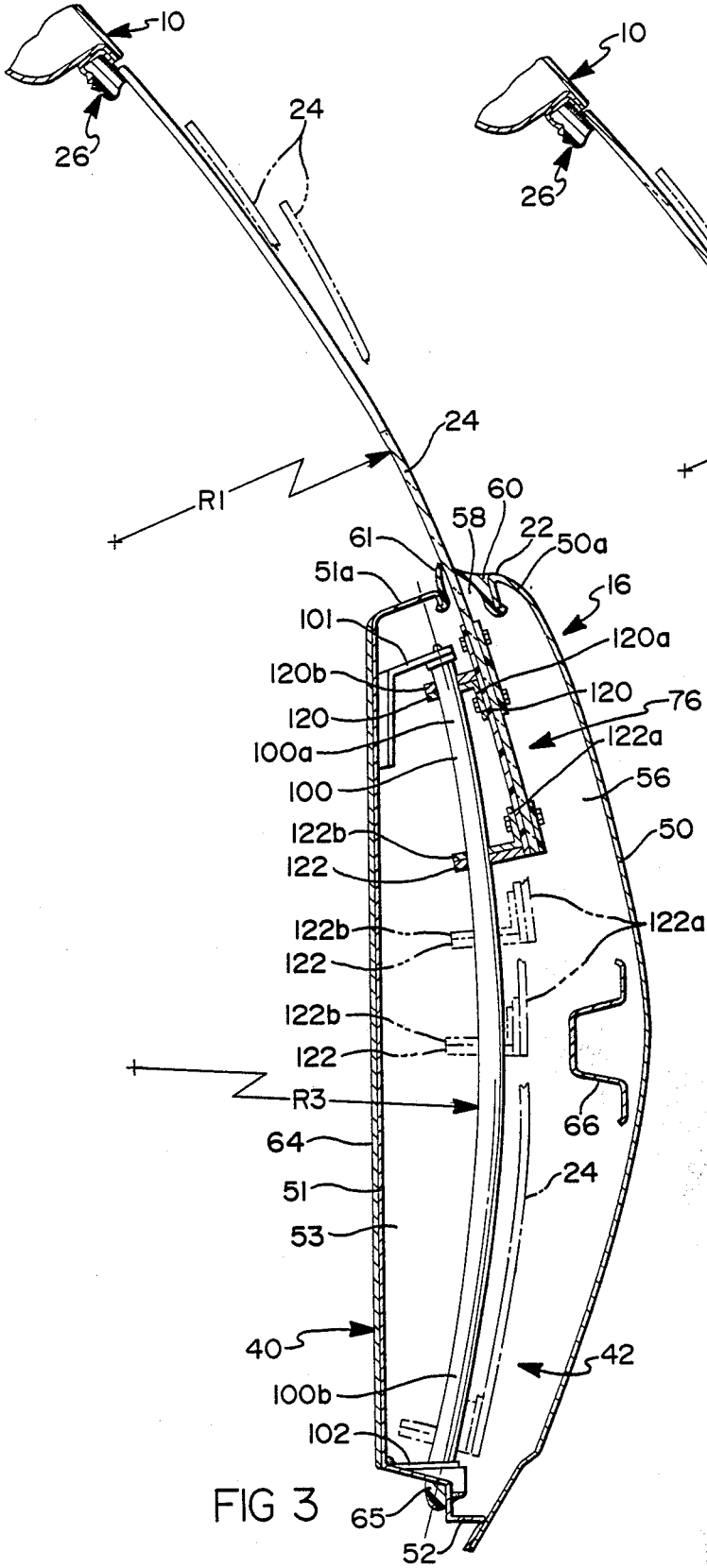
FIG. 3 is an enlarged sectional view taken approximately along line 3—3 of FIG. 2.
Figure 4:
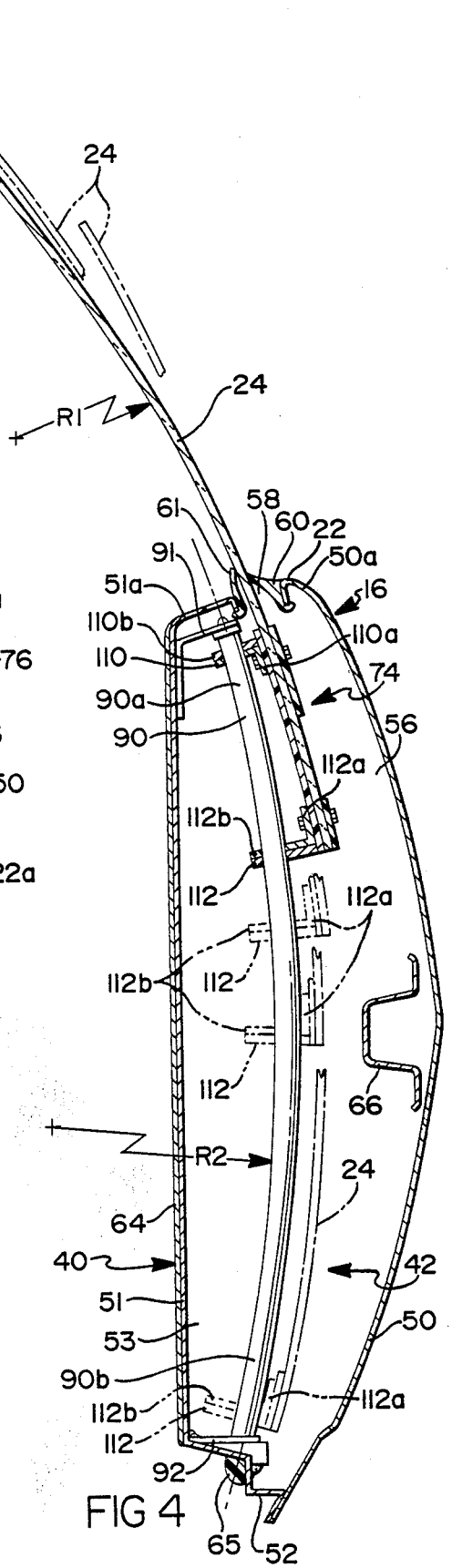
FIG. 4 is an enlarged sectional view taken approximately along line 4—4 of FIG. 2.

The door subassembly 40 comprises, as best shown in FIGS. 2–4, a vehicle door having an outer panel 50, an inner panel 51, a bottom panel or wall 52 and end walls 53 and 54 which are suitably secured together such as by welding, and which together define a well or housing 56 which is open at the belt line 22 of the door subassembly 40. The outer and inner panels include inwardly extending portions 50*a* and 51*a* adjacent their upper end at the belt line to define an elongated opening or slot 58 through which the window 24 may pass. The upper ends 50*a* and 51*a* also carry suitable flexible elastomeric seals 60 and 61 for closing off the opening 58 and which engage opposite sides of the window glass 24 to provide a seal between the glass and the well 56 of the door subassembly 40. The door subassembly 40 also includes an inner trim panel 64 which is suitably secured to the inner panel 51 on its interior side adjacent the passenger compartment on the vehicle. A suitable elastomeric seal 65 surrounding the inner trim panel 64 along the bottom and sides of the inner panel 51 of the door is provided for sealingly engaging against the outer body structure 12 of the vehicle when the door is in its closed position.

The door assembly 16 also includes a side impact beam 66 which is generally hat shaped and secured to the opposite end walls 53 and 54. The impact beam 66 is generally hat shaped and is disposed adjacent the outer door panel 50 intermediate its upper and lower ends.

The door subassembly 40 also wholly supports and contains the window regulator mechanism 42. The window regulator mechanism 42 comprises, in general, a sash plate 70 secured to the window 24 adjacent its lower edge, as viewed in FIG. 2, a scissors type window regulator means 72 operatively connected with the sash plate 70 for raising and lowering the window 24 and first and second guide means 74 and 76 for guiding the movement of the window 24 through a controlled path when it is being raised or lowered by the window regulator means 72. The sash plate 70, as shown in FIG. 2, comprises an elongated horizontally disposed C-shaped channel having its opposite ends secured to the lower end of the window 24. The window regulator means 72 is of the scissors type and can be of any suitable or conventional construction. It is carried by the inner panel 51 and comprises a pair of pivotally connected arms 80 and 81 whose upper ends are connected to rollers rollably and slidably received within the C-shaped sash channel 70. The arm 81 has its lower end connected to a roller rollably received in a channel 82 carried by the inner panel 51 and the arm 80 has a sector gear (not shown) at its lower end which is in meshed engagement with a gear of a means (not shown) for causing the arm 80 to be rotated. The means (not shown) for rotating the arm 80 could be either manual or power operated means for causing the upper ends of the arms 80, 81 to be moved toward and away from each other to raise and lower the window 24 and in a conventional manner. If manual, a suitable handle 85 carried by the inner door panel 51 would be provided.

The first and second guides means 74 and 76 guide the movement of the unframed window 24 through a controlled path during its movement between open and closed positions. The window 24, in the preferred embodiment, is curved as viewed in cross section or from its end (see FIG. 3) and lies in a plane having a radius of curvature R1. As noted before, the window 24 in its closed position, engages the outer seal 26 on the vehicle body 12 along the top and upper side portions of the opening 14 to provide a seal between the window 24 and the passenger compartment 20 of the vehicle A.

The first and second guide means 74 and 76 function to guide the movement of the window 24 when it is being lowered from its closed position, as shown by the solid lines in FIG. 3, towards its open position, as shown by the phantom lines in FIG. 3, along a path such that the upper end portion of the window 24 is caused to be initially moved outwardly away from the seal means 26 and its lower end portion is caused to be moved inwardly toward the inner panel 51 during a first portion of its downward movement and then to move along a path which is approximately or substantially the same as its radius of curvature R1 during a latter portion of its downward movement. In addition, the first and second guide means 74 and 76 also cause the window 24, as it is being moved from its closed position towards its open position, to be moved longitudinally or translationally relative to the end walls 53 and 54 of the vehicle door, as shown by the difference in FIG. 2 between the solid line closed position and the phantom line open position. The first and second guide means 74 and 76 cause the window 24 to be removed through a reverse path of movement when it is being moved from its open position towards its closed position.

The first guide means 74, as best shown in FIG. 4, has a guide post or guide tube 90 disposed within the well 56 of the door subassembly 40 and has its upper and lower ends suitably welded or otherwise secured to brackets 91 and 92, the brackets 91 and 92 in turn being welded or otherwise secured to the inner wall 51 and the bottom wall 52 of the door subassembly 40, respectively. The guide tube 90, as viewed from the end of the door assembly 16, as shown in FIG. 4, is vertically curved throughout its length so as to have a radius of curvature R2 which is substantially the same as the radius of curvature R1 of the window glass 24. The guide tube 90 also has upper and lower portions 90*a* and 90*b*, as viewed in plan from the side of the door, as shown in FIG. 2. The lower portion 90*b*, as viewed in FIG. 2, extends in a plane which is skewed with respect to a vertical plane 94 passing through its lower end so as to form an acute included angle therebetween and the upper portion 90*a* is skewed with respect to the lower portion 90*b* and defines with the vertical plane 94 a larger acute included angle therebetween. The tube 90 is actually curved throughout its length (see FIG. 5), but appears like it is comprised of upper and lower linearly extending portions 90*a* and 90*b* as viewed in plan as shown in FIG. 2.

The second guide means 76 also comprises a tube or post 100 having upper and lower portions 100*a* and 100*b*. The second tube 100 is also curved, as viewed in FIG. 3 from the end 54 of the door subassembly 40, and has a radius of curvature R3 which is substantially equal to the radius of curvature R1 of the window 24. Likewise the upper and lower ends of the tube 100 are secured or welded to brackets 101 and 102 which are in turn suitably secured to or welded to the inner wall 51 of the door subassembly 40 and the bottom wall 52 thereof. The lower portion 100*b* of the tube 100 is virtually identical to the lower portion 90*b* of the tube 90 in that it extends along a plane which is skewed with respect to a vertical plane 104 extending through its bottom-most portion of the tube 100 so as to define the acute included angle therebetween. The lower portions 90*b* and 100*b* of the tube 90 and 100 extend parallel to each other, as viewed in plan as shown in FIG. 2. The upper portion 100*a* of the tube 100, however, extends along a plane which is substantially or generally vertical, as viewed in plan as shown in FIG. 2. Thus the upper portions 90*a*, and 100*a* of the tubes 90 and 100 diverge away from each other proceeding from the midportion of the tubes 90 and 100 towards their upper ends as clearly shown in FIG. 2. The tube 100 actually is curved throughout its length, as best shown in FIG. 5, but appears like it is comprised of upper and lower linearly extending portions 100*a* and 100*b* as viewed in plan in FIG. 2.

Slidably disposed on the guide tube 90 are a pair of vertically spaced first and second guide members or plates 110 and 112. The guide plates 110 and 112 are generally L-shaped and have one leg 110*a* and 112*a* thereof suitably bolted or otherwise secured to the lower end of the window 24 adjacent its left end, as shown in FIG. 2, and their other leg 110*b* and 112*b* disposed generally horizontlly. The horizontally disposed legs 110*b* and 112*b* have elongated horizontally extending slots 115 and 116, respectively, for slidably receiving the guide tube 90. The horizontal slot 115, as best viewed in FIG. 5, has a first portion 115*a* which is linear and whose axis 115*b* is skewed with respect to or forms an acute included angle with the plane of the window 24 so that its leftmost end extends further away from the plane of the window 24 then its rightmost end portion. The horizontal slot 115 also includes a second portion 115*c* which is spaced from, but extends generally parallel with the plane of the window 24. The slot 116 in the second guide 112 is linear throughout and extends along an axis 116*a* which is skewed with respect to the plane of the glass of the window 24. The slot 116 at its leftmost end, FIG. 5, is spaced further away from the window 24 than at its rightmost end, as view in FIG. 5.

The guide means 76, in addition to the tube 100, includes third and fourth vertically spaced guide members or plates 120 and 122 which are slidably received on the post or tube 100. The guide plates 120 and 122 are both L-shaped and have a first vertically disposed leg 120*a* and 122*a* thereof bolted or otherwise suitably secured to the lower end of the window 24 adjacent its rightmost end, as viewed in FIG. 2. The L-shaped guide plates 120 and 122 also include horizontally extending legs or flanges 120*b* and 122*b* having elongated horizontally extending slots 125 and 126 therethrough which slidably receive the post 100. The slot 125 has a first or leftmost portion 125*a* as viewed in FIG. 5, which is spaced from, but extends parallel to the plane of the glass 24 and has a second or rightmost end portion 125*b* which is generally linearly but extends along an axis 125*c* which is skewed with respect to the plane of the window glass 24 so as to define an acute included angle therebetween. That is, the rightmost end of the slot portion 125*b* extends further from the plane of the glass 24 than does its leftmost end, as best shown in FIG. 5. The slot 126 in the fourth guide plate 122 extends linearly throughout its length and along an axis 126*a* which is skewed with respect to the plane of the window glass 24 to form an acute included angle therebetween. The rightmost end of the slot 126 is further away from the window 24 than the leftmost end. As can be best seen from FIG. 5, the slots 116 and 126 extend in opposite directions from each other, i.e., their axes 125*c* and 126*a* diverge away from each other proceeding from the plane of the window 24 and form an obtuse included angle.

Figure 5:
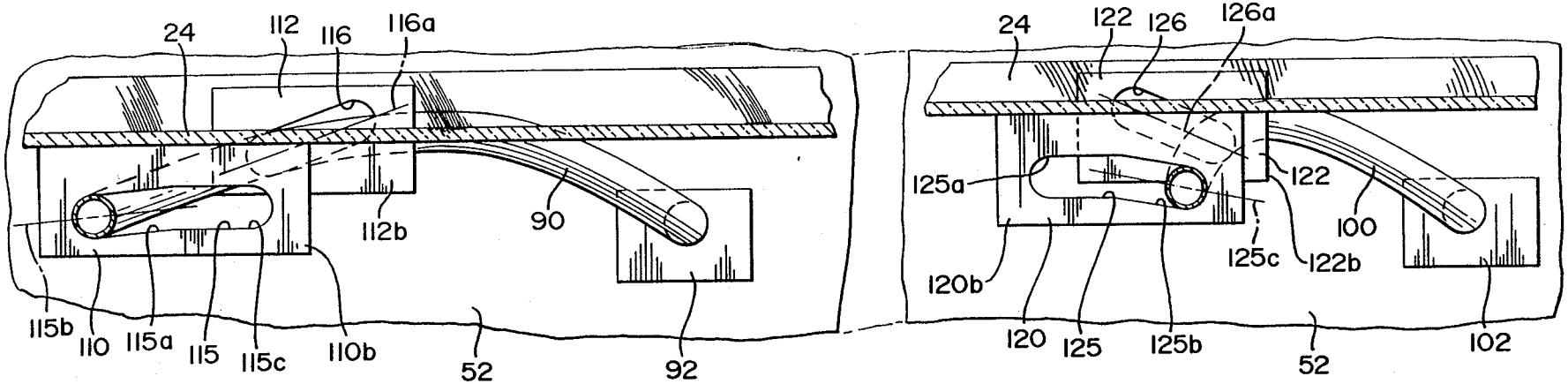
FIG. 5 is an enlarged fragmentary sectional view taken approximately along line 5—5 of FIG. 2.
Figure 6:
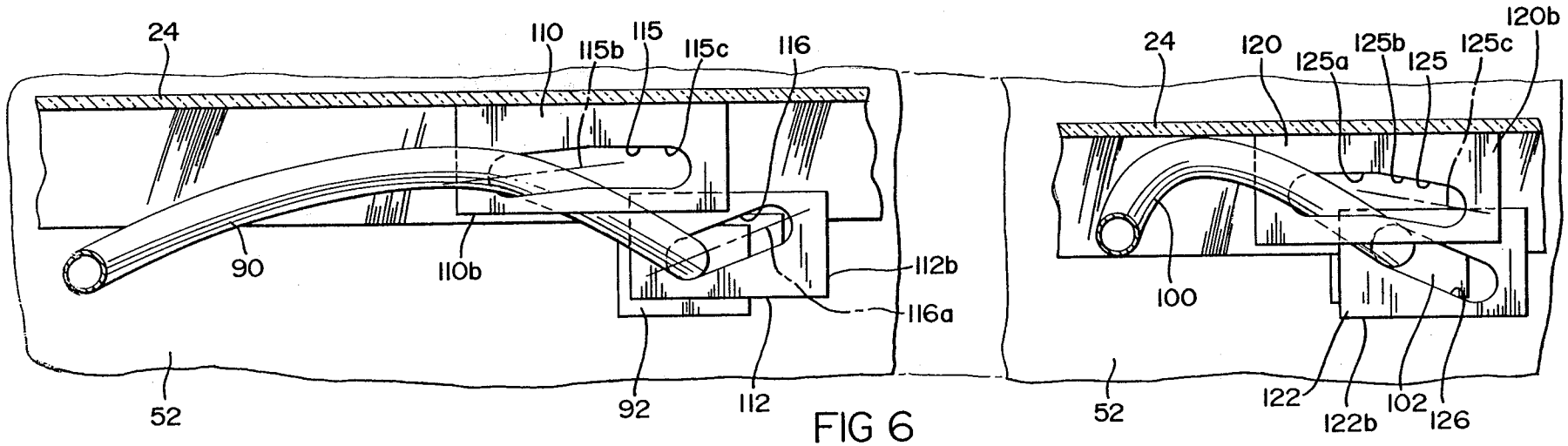
FIG. 6 is a view like that shown in FIG. 5, but showing different parts thereof in a different position.

When the window 24 is in its closed position, as shown in FIGS. 2 and 5, the guides 110 and 112 and 120 and 122 are positioned relative to their respective guide tubes 90 and 100 so that the leftmost ends of the guide slots 115 and 116 and the rightmost end of the guide slots 125 and 126 are in engagement with the guide tubes 90 and 100, respectively. When the window 24 is moved from its closed position to its fully open position, the relative position of the guides 110 and 112 and 120 and 122 relative to their respective guide posts 90 and 100 is such that the rightmost ends of the slots 115 and 116 and the leftmost ends of the slots 125 and 126 are engaged with their respective posts 90 and 100, as best shown in FIG. 2.

The configuration of the guide tubes 90 and 100 and the configuration of the slots 115, 116 and 125, 126 in the guide plates 110, 112 and 120, 122, respectively, are such that the guide means 74 and 76 cause the window 24 as it is being lowered from its closed position towards its open position, to be pivoted about a theoretical pivot point at or adjacent the belt line 22 of the door assembly 16 so as to cause the upper portion of the window 24 to be moved outwardly relative to the seal means 26 to disengage the same and at the same time cause the lower end of the window 24 to be moved inwardly of the door subassembly 40 toward the inner door panel 51 during a first portion or first half of its downward movement. As the window 24 is being lowered and its lower end approaches a position adjacent the door beam 66, as shown in FIGS. 3 and 4, the guide slots 115, 116 and 125, 126 and guide tubes 90 and 100, respectively, are configured such as to thereafter cause the window 24 to be moved along or substantially along its radius of curvature R1 during the remaining downward movement towards its fully open position. This pivoting movement of the window 24 as it is being lowered from its closed position towards its open position not only allows the window 24 to disengage from pressure engagement with the seal means 26 and thereby reduce the friction during further downward movement but also enables the lower end of the window 24 to be pivoted inwardly toward the inner door panel 51 so as to clear the door impact beam 66 and enable the latter to be positioned adjacent the outer door panel 50. This inward movement of the window 24 also enables the overall width of the door subassembly 40 to be minimize, since the impact beam 66 can be located closer to the inner door panel 51. In addition, it should be noted that the guide posts 90, 100 and remaining parts of the window regulator mechanism 42, etc., are all supported and carried by the door subassembly 40 adjacent the inner door panel 51 so that unrestricted and free movement of the window glass 24 between the guide posts 90, 100 and the impact beam 66 is permitted.

It should further be noted that the configuration of the guide tubes 90, 100 are such that the window 24 is also caused to be moved longitudinally relative to the door between its end walls 53 and 54 so that it can be fully received within the well 56 of the door. During the first portion of the downward movement of the window, the configuration of the slots 115, 125 also enables the window to be moved longitudinally of the door while at the same time it is being pivoted about the belt line 22 of the door and during the latter portion of its downward movement, the guide slots 115, 125 and skewed, parallel extending portions 90*b*, 100*b* of the guide tubes 90, 100 cause the window 24 to be also moved toward end wall 54 and be fully received within the well 56.

Additionally, it should be noted that the provision of the four guides 110, 112 and 120, 122 slidably guided on their respective tubes 90, 100 provides a four point stabilizing support and guide arrangement for the window glass 24 so that the window glass is positionally stabilized in all directions regardless the position to which it is moved, even when adjacent its closed position when it is almost wholly disposed above the belt line 22 of the door subassembly 40.

It should further be apparent that with the provision of the four guides 110, 112 and 120, 122 that the window 24 is, for any given vertical position, horizontally trapped between the guide tubes 90, 100 so that it cannot shift longitudinally relative to the door beyond tolerance limitations.

From the foregoing, it should be readily apparent that a novel window regulator mechanism for guiding, supporting ad controlling the movement of a frameless window for a vehicle door assembly has been provided. The guide arrangement of the window regulator mechanism enables the window to be positionally stabilized in all directions regardless of its position, eliminates horizontal shifting of the window for any given vertical position, although allowing horizontal shifting movement to occur while being vertically moved, and enables the window to pivot into and out of engagement with its associated seal as it moves away from and approaches its closed position so as to reduce friction during its opening and closing movements.

It should also be understood that while, in the preferred embodiment, the vehicle door assembly and frameless window 24 have been shown for use in a side door assembly for a hard top type vehicle, that it could also be employed for raising and lowering a tailgate window of a station wagon type vehicle. In this latter type of application, the window would merely be caused to be pivoted toward and away from its associated seal as it is vertically raised and lowered and would not, in most applications, require that the guide tubes be shaped so as to also cause translational movement between the sides end walls of the tailgate.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. In an automotive vehicle having body structure defining a body opening and an exterior seal on the body structure adjacent the body opening and extending along its top and upper side portions of its sides, a frameless door assembly supported by the body structure for movement between open and closed positions, said door assembly comprising a door having inner and outer spaced panels and a pair of end walls which together define a well, a window supported for movement between an open position in which it is disposed within said well and a closed position in which it is disposed within said well and a closed position in which a major portion thereof is disposed above the door and in which its top and sides engage said exteriorly facing seal on the body structure, and a window regulator mechanism carried by said door assembly and operatively connected with said window for supporting and moving said window between its open and closed positions, said window when being moved from its closed position toward its open position moving along a path in which its upper end moves away from said seal during a first portion of its downward movement and when being moved from its open position toward its closed position being movable along a reverse path, the improvement being that said window regulator mechanism comprises first and second curved horizontally spaced, guide posts disposed within said well and fixed to said door assembly, first and second vertically spaced guides secured to said window adjacent its lower end and adjacent one side thereof, third and fourth vertically spaced guides secured to said window adjacent its lower end and adjacent its other side thereof, said first and second and said third and fourth guides having elongated slots therein for respectively slidably receiving said first and second guide posts whereby said window is stabilized in directions to and from the plane of the window, said slots in said guides having a configuration and said posts having a curvature such that the window for any given position during its downward or upward movement is trapped against horizontal movement relative to the guide posts and such that the window is caused to be translationally moved from one of said end walls defining said well toward the other of said end walls as well as having its upper end caused to be moved outwardly of said seal during a first portion of its downward travel when the window is being moved from its closed position toward its open position and being moved in reverse direction during a latter portion of its upward travel when being moved from its open position toward its closed position.

2. In an automotive vehicle having body structure defining a body opening and an exterior seal on the body structure adjacent the body opening and extending along its top and upper side portions of its sides, a frameless door assembly supported by the body structure for movement between open and closed positions, said door assembly comprising a door having inner and outer spaced panels, a bottom and a pair of end walls which together define a well, a curved window supported for movement between an open position in which it is disposed within said well and a closed position in which a major portion thereof is disposed above the door and in which its top and sides engage said exteriorly facing seal on the body structure, and a window regulator mechanism carried by said door assembly and operatively connected with said window for supporting and moving said window between its open and closed positions, said window regulator mechanism effecting movement of said window upon being moved from its closed position toward its open position along a path in which the window is translationally moved from one end wall toward its other end wall as well as having its upper end move away from said seal and its lower end move away from the outer panel during a first portion of its downward movement and then to follow along a path substantially equal to its radius of curvature during a second portion of its downward movement and effecting movement of the window along a reverse path when being moved from its open position toward its closed position, said window regulator mechanism comprising first and second curved guide posts located in said well fixed to said door assembly, said guide posts being vertically curved so as to extend along substantially the same directions as the path of movement of the window, first and second vertically spaced guides secured to said window adjacent its lower end and adjacent one side thereof, third and fourth vertically spaced guides secured to said window adjacent its lower end and adjacent its other side, said first and second and said third and fourth guides having elongated slots therein for respectively slidably receiving said first and second guide posts whereby said window is stabilized in directions to and from the plane of the window, said slots in said guides having a configuration and the curvature of said posts being such that the window for any given position during its downward or upward movement is trapped against horizontal movement relative to the guide posts and being such that the window is caused to be translationally moved and the upper end of said window is caused to be moved outwardly of said seal and the lower end inwardly from the outer panel of said door assembly during a first portion of its downward travel and then along the radius of curvature of the window and vice versa when the window is being moved from its closed position toward its open position from its open position toward its closed position, respectively.

3. A frameless door assembly for use with a hard top type vehicle having body structure defining a body opening surrounded at its top and upper side portions by a flexible seal and which is adapted to be supported by the body structure for movement between open and closed positions, said door assembly comprising a door having inner and outer spaced panels a bottom and first and second end walls which together define a well, a frameless curved window supported for movement between an open position in which it is wholly disposed within said well and a closed position in which a major portion thereof is disposed above the door at its belt line and in which its top and sides are engageable with the seal, and a window regulator mechanism for supporting and moving said window and which is operable to move said window from its closed position toward its open position along a path in which the window translationally moves from said first end wall toward said second end wall and has its upper end move away from said seal and its lower end move away from the outer panel during a first portion of its downward movement and then to follow along a path substantially equal to its radius of curvature during a second portion of its downward movement and which is operable to move the window through a reverse path when the window is being moved from its open position toward its closed position said window regulator mechanism comprising first and second fixed, guide posts carried by said door assembly, said guide posts being vertically curved so as to extend along substantially the same direction as the path of movement of the window, as viewed from the door end walls, said guide posts, as viewed from the plane of the window, having upper portions which converge toward each other and lower portions which extend parallel to each other but whose axes are skewed with respect to a vertical axis through the door, first and second vertically spaced guides secured to said window adjacent its lower end and adjacent one side thereof, third and fourth vertically spaced guides secured to said window adjacent its lower end and adjacent its other side thereof, said first and second and said third and fourth guides having slots therein for respectively slidably receiving said first and second guide posts whereby said frameless window is stabilized in directions to and from the plane of the window, said slots in said first and third guides having configurations which extend generally parallel to the plane of said window and said slots in said second and fourth guides having generally linear configurations which are skewed with respect to the plane of said window, said configurations of said slots in said guides functioning to stabilize said window against movement to and from the plane of the window and trapping said window against horizontal movement relative to the guide posts for any given vertical position of said window, said configuration of said slots in said guides and the curvature and configuration of said posts also causing said window to pivot about the belt line of the door and causing the upper end of said window to be moved outwardly of said seal and the lower end inwardly from the outer panel of said door as well as causing said window to be moved translationally relative to the door during a first portion of its downward travel and then along the radius of curvature of the window and vice versa when the window is being moved from its closed position toward its open position and from its open position toward its closed position, respectively.

4. A frameless door, as defined in claim 3, and wherein said guide posts are tubular and curved throughout their length and wherein said slot in said first guide has a first end portion which is slightly skewed with respect to the plane of the window and a second end portion which extends parallel with the plane of the window and said slot in said third guide has a first end portion extending parallel to the window and a second end portion which is slightly skewed with respect to the plane of the window, respectively, and wherein said linear slots in said second and fourth have longitudinally extending axes which diverge away from each other proceeding from the plane of the window.

5. A frameless door assembly, as defined in claim 3, and wherein said guide posts are secured to the inner panel and bottom of said door and said door assembly includes a side impact beam adjacent the outer panel of said door and wherein said window during the first portion of its downward movement in which its lower end is caused to be moved inwardly from the outer panel clears the impact beam.

6. A frameless door, as defined in claim 5, and wherein said guide posts are tubular and curved throughout their length and wherein said slot in said first guide has a first end portion which is slightly skewed with respect to the plane of the window and a second end portion which extends parallel with the plane of the window and said slot in said third guide has a first end portion extending parallel to the window and a second end portion which is slightly skewed with respect to the plane of the window, respectively, and wherein said linear slots in said second and fourth guides have longitudinally extending axes which form an obtuse included angle therebetween.

* * * * *